US007836802B2

(12) United States Patent
Yoon

(10) Patent No.: US 7,836,802 B2
(45) Date of Patent: Nov. 23, 2010

(54) CENTRIFUGAL ELECTRIC IMPACT WRENCH

(75) Inventor: Ja Young Yoon, Seoul (KR)

(73) Assignee: Dongeun Electronics Co., Ltd., Seoul (KR)

( * ) Notice: Subject to any disclaimer, the term of this patent is extended or adjusted under 35 U.S.C. 154(b) by 202 days.

(21) Appl. No.: 12/066,386

(22) PCT Filed: Sep. 8, 2006

(86) PCT No.: PCT/KR2006/003582

§ 371 (c)(1),
(2), (4) Date: Mar. 10, 2008

(87) PCT Pub. No.: WO2007/029985

PCT Pub. Date: Mar. 15, 2007

(65) Prior Publication Data

US 2008/0196555 A1 Aug. 21, 2008

(30) Foreign Application Priority Data

Sep. 9, 2005 (KR) ..... 10-2005-0084025

(51) Int. Cl.
*B25B 21/02* (2006.01)

(52) U.S. Cl. ..... 81/464; 81/57.11

(58) Field of Classification Search ..... 81/54, 81/55, 56, 57, 57.11, 464
See application file for complete search history.

(56) References Cited

U.S. PATENT DOCUMENTS

| | | | | |
|---|---|---|---|---|
| 5,435,398 | A * | 7/1995 | Juan | 173/176 |
| 5,954,141 | A * | 9/1999 | Li et al. | 173/93.5 |
| 6,491,112 | B1 * | 12/2002 | Shin | 173/93.5 |
| 6,836,614 | B2 * | 12/2004 | Gilmore | 388/811 |
| 7,168,340 | B1 * | 1/2007 | Green | 81/57.3 |
| 2002/0098938 | A1 * | 7/2002 | Milbourne et al. | 475/286 |

* cited by examiner

*Primary Examiner*—Hadi Shakeri
(74) *Attorney, Agent, or Firm*—Joseph Hyosuk Kim; JHK Law

(57) ABSTRACT

Disclosed is a centrifugal impact wrench using an electric driving motor, which is rotated by electricity supplied from an electric power source, as a power source. The electric impact wrench includes: a sun gear 21 coupled to a rotation shaft 11 of the electric driving motor 10 and rotating; a plurality of planetary gears 22 including first gear 22*a* engaged with the sun gear 21 and rotating, and second gear 22*b* having a smaller diameter than the first gear 22*a*; an output gear 23 engaged with the second gear 22*b* of the planetary gear 22 and rotating; an inertia wheel 50 rotated by rotation force transmitted from the output gear 23; a spindle 70 rotatably connected to a front portion of the inertia wheel 50 and provided with a connector 71 at a side of the spindle 50; and a blow body 60 hitting the connector 71 when centrifugal force caused by the rotation of the inertia wheel 50 increases over a predetermined extent, and returning to an initial position by means of a return spring 67 when the centrifugal force caused by the rotation of the inertia wheel 50 is reduced below a predetermined extent.

16 Claims, 7 Drawing Sheets

[Fig. 3]
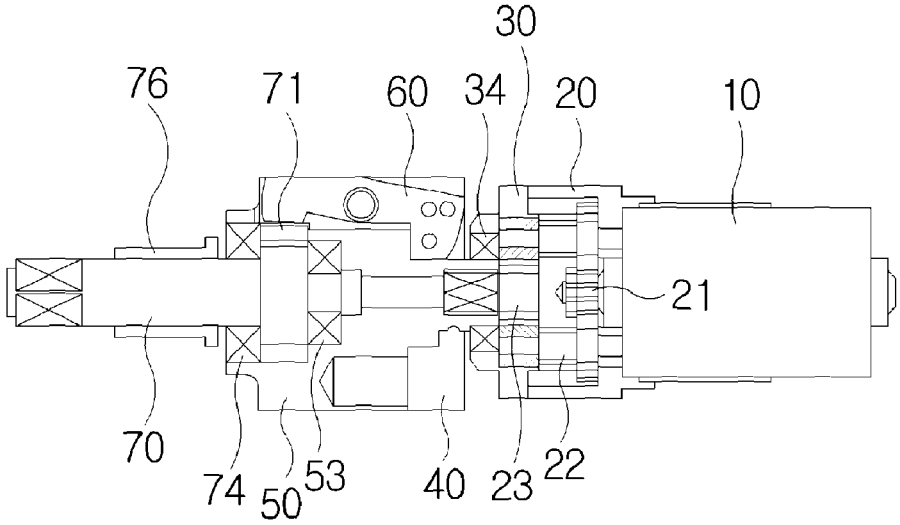
[Fig. 4]
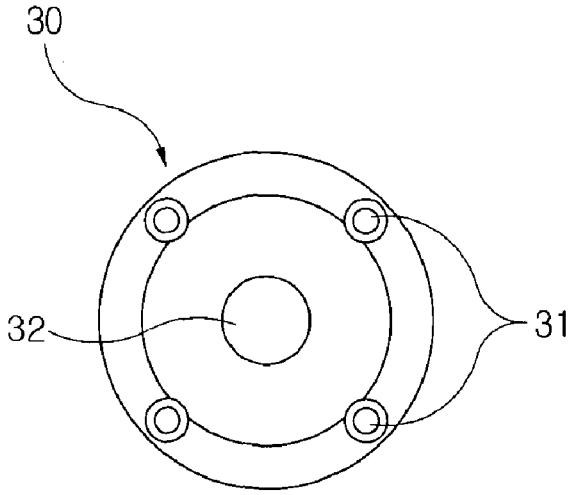
[Fig. 5]
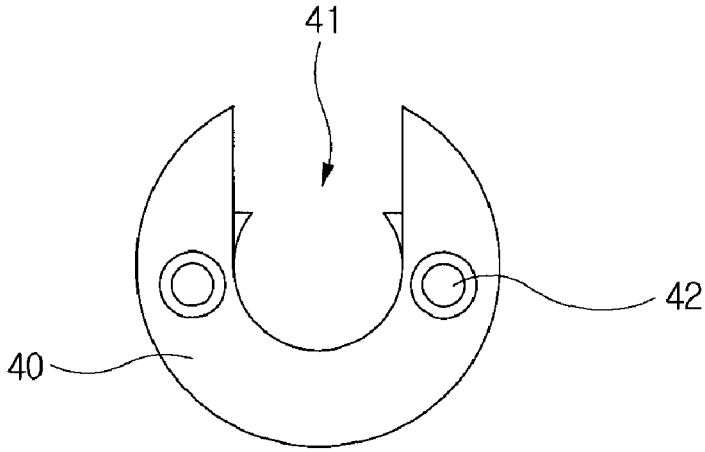

[Fig. 6]
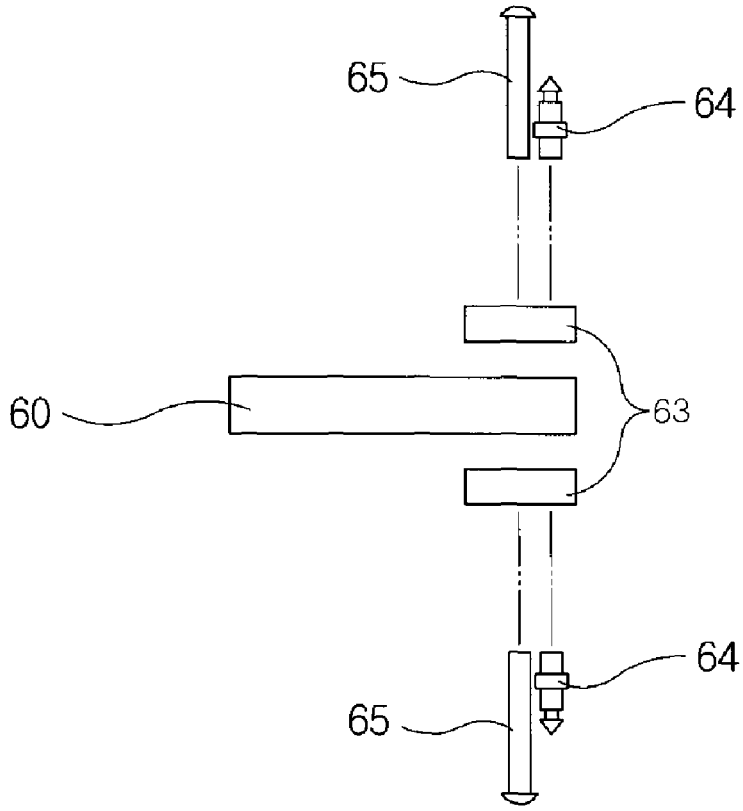
[Fig. 7]
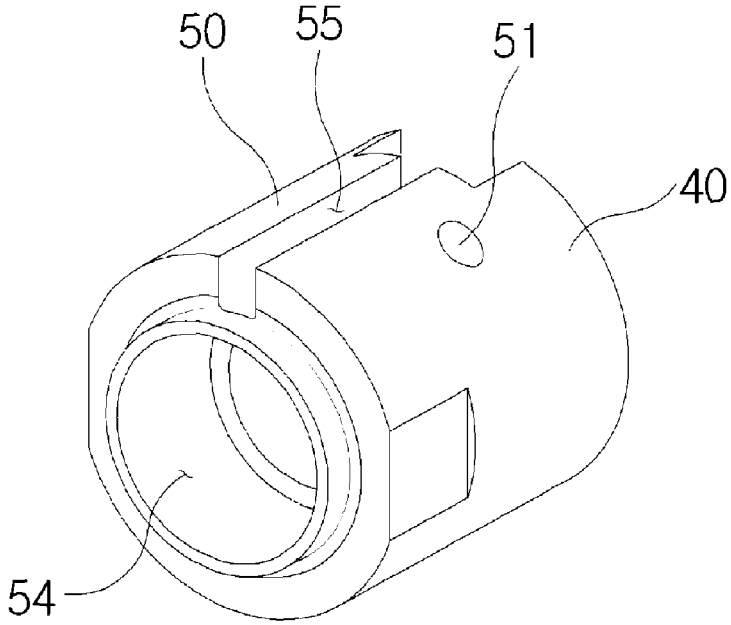

[Fig. 8]
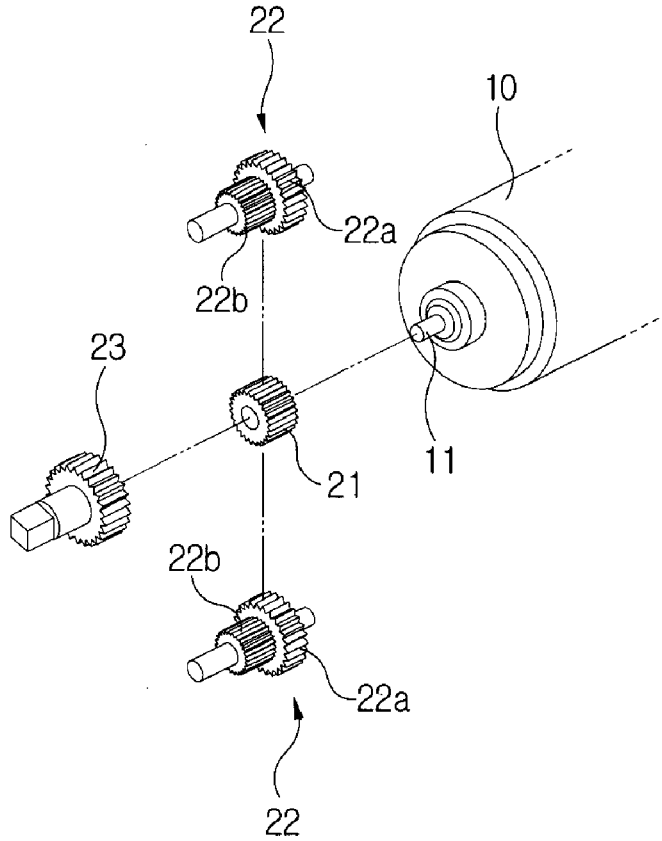
[Fig. 9]
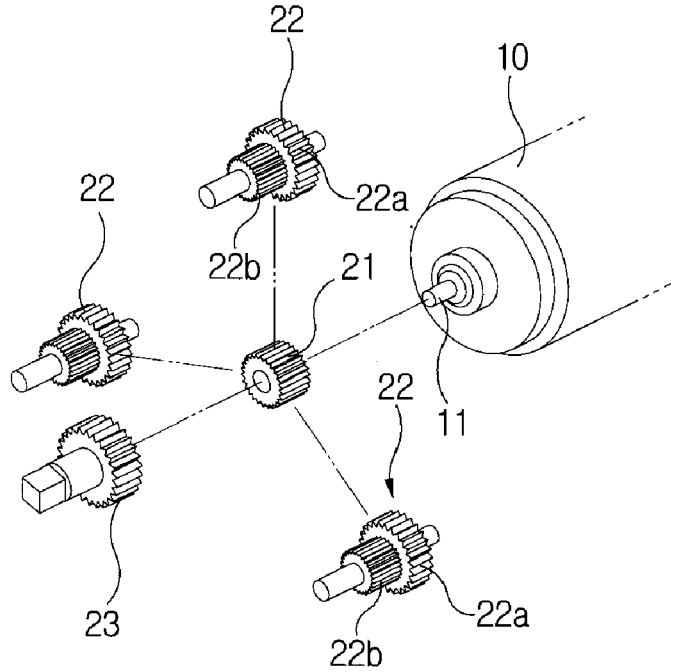

[Fig. 10]
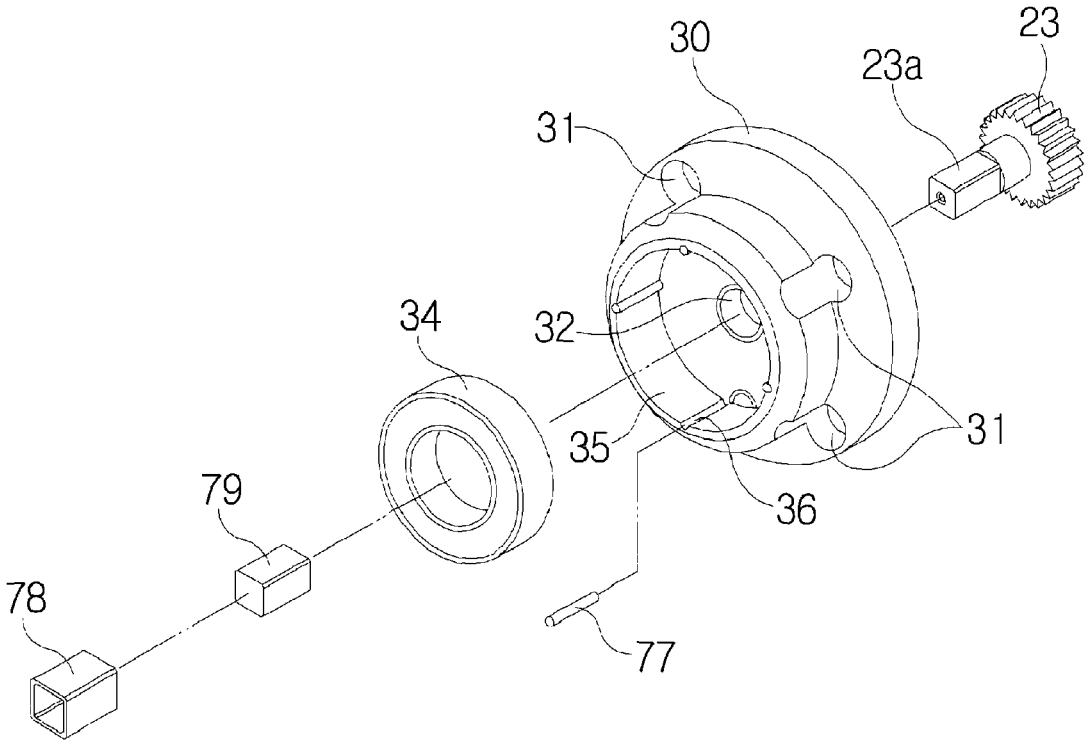
[Fig. 11]
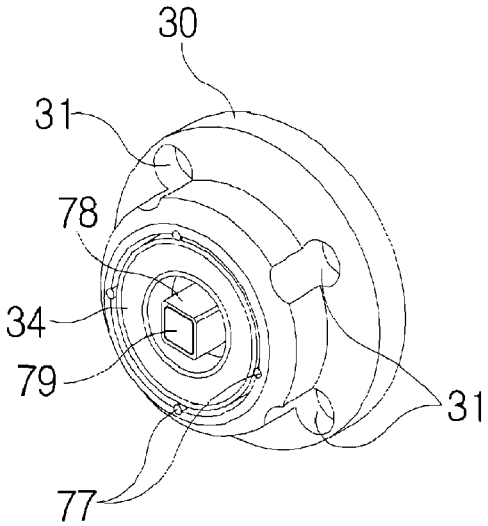

[Fig. 12]
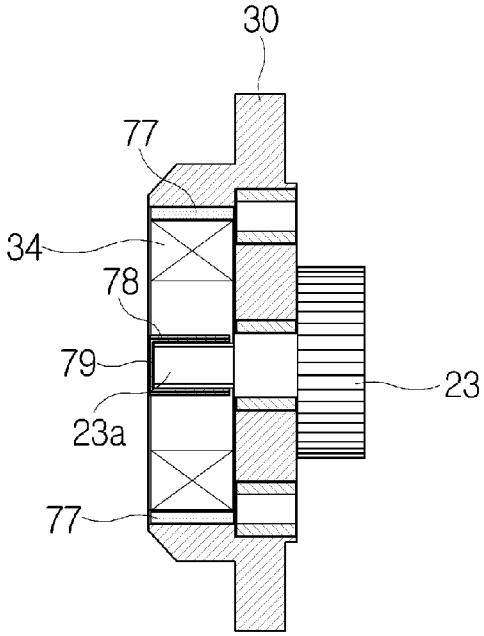
[Fig. 13]
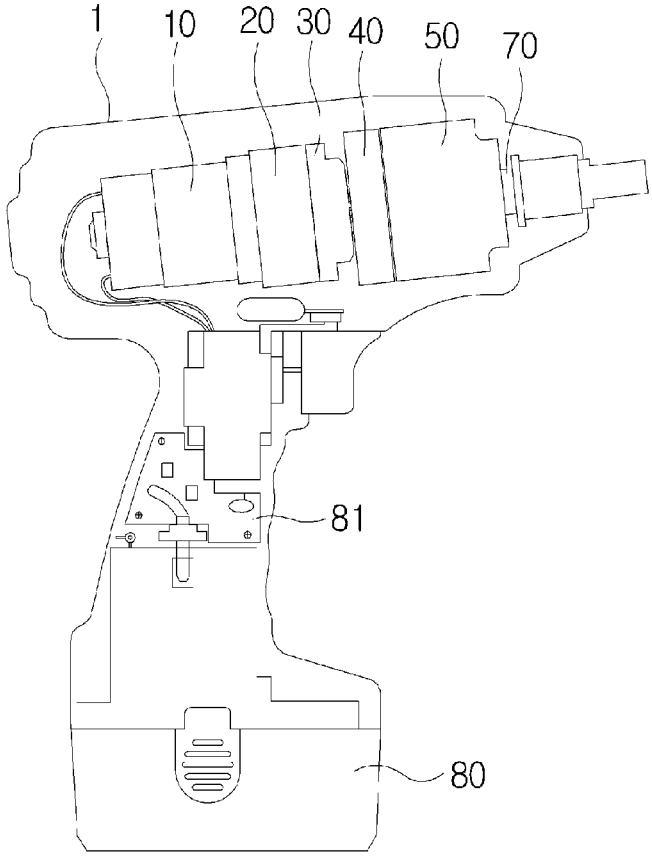

CENTRIFUGAL ELECTRIC IMPACT WRENCH

TECHNICAL FIELD

The present invention relates to an impact wrench operated by electric power, and more particularly to a centrifugal electric impact wrench, which can remove a hunting characteristic at impact timing and in an acceleration section by suitably reducing rotation force generated from a driving electric motor through a reduction gear, thereby stably transmitting power with high torque at a low velocity, and absorbing or alleviating impact on the reduction gear.

BACKGROUND ART

Generally, coupling members, such as bolts, for coupling wheels to a vehicle require high coupling force. Especially, there is a problem in that women, the old or the disabled has difficulty in coupling bolts, etc. for mounting wheels to a vehicle using a conventional manual wrench.

In order to solve such a problem, Korean Patent No. 328512 has proposed a technology for an electric impact wrench, which can couple or disassemble bolts for mounting wheels to a vehicle using the power of an electric motor.

The conventional electric impact wrench will be described in detail with reference to FIG. 1. A shaft 112 of an electric motor 109 is connected to a shaft portion 106*a* at a side of an inertia wheel 106 rotatably supported by a bearing 113. The inertia wheel 106 has an annular groove formed at the other side thereof. A bearing 114 rotatably supporting a spindle 104 is received in a groove of the inertia wheel 106. The other side of the spindle 104 is supported by a bearing 115.

Further, the inertia wheel 106 has a cut portion 116, which is cut lengthwise along an outer peripheral surface thereof. A blow body 103 is received lengthwise in the cut portion 116. The blow body 103 is installed in the cut portion 116 to pivot upward and downward around a pin 117 in such a manner that the pin 117 is inserted into a pin insertion hole 119 and a pin thru-hole 118 in a state that the pin insertion hole 119 formed in the inertia wheel 106 is coaxial with the pin thru-hole 118 formed in the blow body 103. Specifically, the blow body 103 is subjected to centrifugal force so that a rear portion of the blow body 103 protrudes upward around the pin 117 when the inertia wheel 106 is rotated by a high-speed rotation (about 4000 rpm) of the electric motor 109. Further, the blow body 103 is provided with a weight member 120 at a rear portion thereof so that the rear portion of the blow body 103 is heavier than the front portion, in order to secure a centrifugal movement, and a pair of ball insertion holes 121 is formed at the rear portion of the pin insertion hole 119 formed in the inertia wheel 106 and extends from both sides to the cut portion 116 of the inertia wheel 106. These ball insertion holes 121 are formed at the rear portion of the blow body 103 to coincide with seating grooves 125 with a hemispheric shape when the blow body 103 is installed in the cut portion 116 of the inertia wheel 106.

Ball pressing springs 123 are inserted into the ball insertion holes 121 respectively, in order to press a pair of balls 124 toward the seating grooves 125 formed at both sides of the blow body 103. In the state that the balls 124 and the ball pressing springs 123 are received in the ball insertion holes 121, respectively, screws 122 for adjusting the ball pressing force are coupled to screw portions formed outside of the ball insertion holes 121.

Therefore, if centrifugal force applied to the blow body 103 by the rotation of the inertia wheel 106 is smaller than elastic restitution of the ball pressing springs 123 applied to the seating grooves 125 through the balls 124, the centrifugal movement of the blow body 103 does not occur. However, if the centrifugal force applied to the blow body 103 is larger than the elastic restitution of the ball pressing spring 123 applied to the seating grooves 125, the balls 124 are released from the seating grooves 125 while upraising the rear portion of the blow body 103 using a pin 117 as a rotation point.

Next, as the blow body 103 instantly hits the connector 105 so as to rotate the spindle 104, it is possible to couple or loosen bolts, used for coupling wheels to a vehicle, through a socket mounted on the spindle 104. However, when the spindle 104 does not rotate anymore because the coupling force of the bolts for mounting the wheels is larger than the rotation force of the spindle 104, or the coupling of the bolts for mounting the wheels is completed, the rotation of the spindle 104 stops.

On the other hand, a return spring 126 is provided on the rear portion of the blow body 103 in order to pull the rear portion of the blow body 103 to an initial position (i.e. a position before the centrifugal force is applied to the rear portion of the blow body 103). Both ends of the return spring 126 are connected to protrusions 127 formed on both sides of the blow body 103 respectively, so that the return spring 126 has a loop shape. The loop-shaped return spring 126 sits on a shaft 106*a* of the inertia wheel 106.

Therefore, when the coupling force of the bolts for mounting wheels is larger than the rotation force of the spindle 104, or the bolts for mounting the wheels are completely coupled, as described above, the centrifugal force applied to the blow body 103 can be removed. When the centrifugal force applied to the blow body 103 is smaller than the elastic restitution of the return spring 126 for returning the blow body 103 to an initial position, the blow body 103 is returned to its initial position by the elastic restitution of the return spring 126. Thus, as the coupling of the blow body 103 to the connector 105 is released during the return of the blow body 103 to the initial position, it is possible to remove the load applied to the electric motor 109.

DISCLOSURE OF INVENTION

Technical Problem

However, since the conventional impact wrench described above has a configuration in which the rotation force generated from the electric motor 109 is directly transmitted to the inertia wheel 106, impact matching is degraded due to high-speed rotation of the electric motor. As a result, there are problems in that hitting timing becomes unstable due to the dislocation of the return spring 126 and hunting phenomenon occurs in an acceleration section.

Technical Solution

Accordingly, the present invention has been made to solve the above-mentioned problems occurring in the prior art, and it is an object of the present invention to provide a centrifugal electric impact wrench that is provided with a reduction gear for reducing rotation force generated by an electric motor at a low velocity and can remove a hunting characteristic at an impact timing and in an acceleration section, thereby stably transmitting power with high torque at a low velocity.

It is another object of the present invention to provide a centrifugal electric impact wrench which can be easy carried and used adapted to special equipment (for example, an expandable pipe coupler) including military equipment while being used in mounting and detaching wheels on/from a vehicle, and provide stable force with high torque at a low velocity.

It is still another object to provide a centrifugal electric impact wrench which can absorb or alleviate impact on a reduction gear, thereby improving durability of the electric impact wrench.

BRIEF DESCRIPTION OF THE DRAWINGS

The foregoing and other objects, features and advantages of the present invention will become more apparent from the following detailed description when taken in conjunction with the accompanying drawings in which:

FIG. 3 is a sectional view showing a centrifugal electric impact wrench of FIG. 2;

FIG. 4 is a front view showing a cover according to the present invention;

FIG. 5 is a front view showing a weight member according to the present invention;

FIG. 6 is a plane view showing a blow body according to the present invention;

FIG. 7 is a perspective view showing an inertia wheel according to the present invention;

FIG. 8 is a perspective view showing a configuration of gears in a reduction gear according to the first embodiment of the present invention;

FIG. 9 is a perspective view showing a configuration of gears in a reduction gear according to the second embodiment of the present invention;

FIG. 10 is an exploded perspective view showing an output gear, a cover, and a buffer cap, etc. according to another embodiment of the present invention;

FIG. 11 is a perspective view showing the output gear, the cover, and the buffer cap, etc. of FIG. 10 which are assembled with one another;

FIG. 12 is a longitudinal sectional view of FIG. 11; and

FIG. 13 is a schematic view showing the entire configuration of a centrifugal electric impact wrench according to the present invention.

BEST MODE FOR CARRYING OUT THE INVENTION

Figure 1:
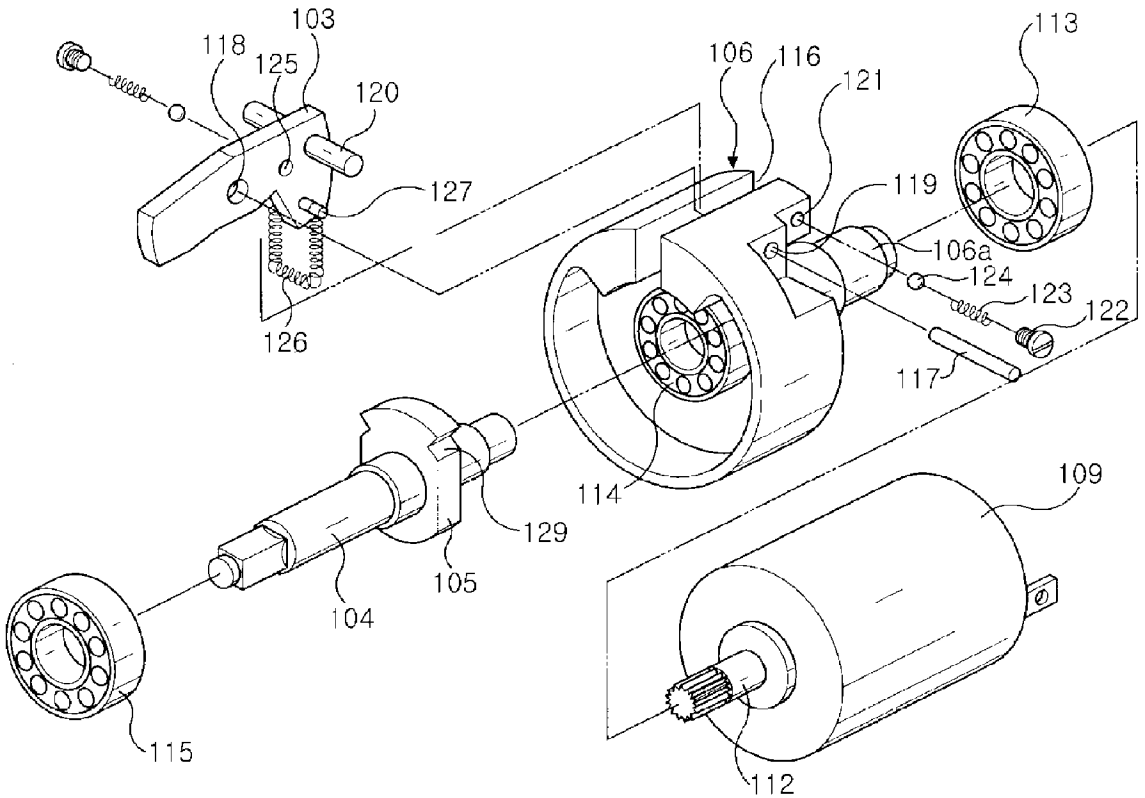
Figure 1 Prior Art
FIG. 1 is an exploded perspective view showing a conventional electric impact wrench.

In order to accomplish these objects of the present invention, according to an aspect of the present invention, there is provided a centrifugal electric impact wrench using an electric driving motor, which is rotated by electricity supplied from an electric power source, as a power source, which includes: a sun gear coupled to a rotation shaft of the electric driving motor and rotating; a plurality of planetary gears including first gear engaged with the sun gear and rotating, and second gear having a smaller diameter than the first gears; an output gear engaged with the second gear of the planetary gear and rotating; an inertia wheel rotated by rotation force transmitted from the output gear; a spindle rotatably connected to a front portion of the inertia wheel and provided with a connector at a side of the spindle; and a blow body hitting the connector when centrifugal force caused by the rotation of the inertia wheel increases over a predetermined extent, and returning to an initial position by means of a return spring when the centrifugal force caused by the rotation of the inertia wheel is reduced below a predetermined extent.

According to the present invention, the centrifugal electric impact further includes: a case coupled to the electric driving motor and enclosing the sun gear, the planetary gears, and the output gear; and a cover closing an open space in the case, where a leading end of the output gear protrudes through a through hole formed in the cover.

According to the present invention, the number of planetary gears is two or three.

According to the present invention, the inertia wheel has circular reception grooves formed at an end of the inertia wheel, bearings are received in the reception grooves and rotatably support the spindle, and a ball used for coupling the spindle to a socket is mounted on a leading end of the spindle and elastically supported by a spring.

According to the present invention, the inertia wheel has a cut portion which is cut lengthwise on an outer peripheral surface, the blow body is received in the cut portion and interposed between connecting members, a mounting pin and connecting pin are respectively fixed to a hole of the blow body, and the blow body is installed in the cut portion so as to pivot upward and downward around the coupling pin in such a manner that a coupling pin extends through and is inserted into the hole and a coupling hole in a state that the coupling hole of the blow body coincides with the hole of the inertia wheel.

According to the present invention, a weight member having a U shaped groove formed is provided to a rear portion of the inertia wheel, so that the rear portion of the inertia wheel has a larger weight than a front portion of the inertia wheel.

According to the present invention, wherein the return spring has a center portion sitting on a connector of the inertia wheel, and both ends connected to a mounting pin to fix a rear portion of the blow body.

According to the present invention, the electric power source is a battery embedded in an electric connector attached to a housing having a desired shape and forming an appearance of the electric impact wrench.

According to the present invention, a DC-DC converter is installed in an electric connector 80 attached to a housing having a desired shape and forming an appearance of the electric impact wrench, in order to use a battery for a vehicle as the electric power source, or an AC-DC converter is installed in an electric connector attached to a housing having a desired shape and forming an appearance of the electric impact wrench, in order to use a battery for a vehicle as the electric power source.

According to the present invention, a controller is preferably provided between the electric power source and the electric driving motor to control voltage and current in order to prevent overload from occurring.

According to the present invention, a buffer cap made of elastic material covers a leading end of the output gear.

According to the present invention, a reinforcement cap is interposed between the leading end of the output gear and the buffer cap.

According to the present invention, the cover has a plurality of insertion grooves circumferentially formed on an inner surface of the cover.

According to the present invention, a buffer made of an elastic material is inserted in the insertion grooves, and partially protrudes from the inner surface of the cover.

According to another embodiment of the present invention, there is provided a centrifugal electric impact wrench, which includes: an electric driving motor rotated by electricity supplied from an electric power source; and a reduction gear having a plurality of gears connected to an electric driving motor so as to reduce rotation velocity and improve output torque, wherein the reduction gear includes: a sun gear coupled to a rotation shaft of the electric driving motor and rotating; a plurality of planetary gears including first gear engaged with the sun gear and rotating, and second gear having a smaller diameter than the first gear; an output gear engaged with the second gear of the planetary gears and rotating; a case coupled to the electric driving motor and enclosing the sun gear, the planetary gear, and the output gear; and a cover closing an open space of the case, wherein a buffer cap made of elastic material covers a leading end of the output gear, a reinforcement cap made of metal is interposed between the leading end of the output gear and the buffer cap, a plurality of insertion grooves is circumferentially formed on an inner peripheral surface of the cover, a buffer made of elastic material is inserted in the insertion grooves, and the buffer partially protrudes from the inner peripheral surface of the cover.

Mode For The Invention

Hereinafter, the present invention will be described in detail with reference to the accompanying drawings.

Figure 2:
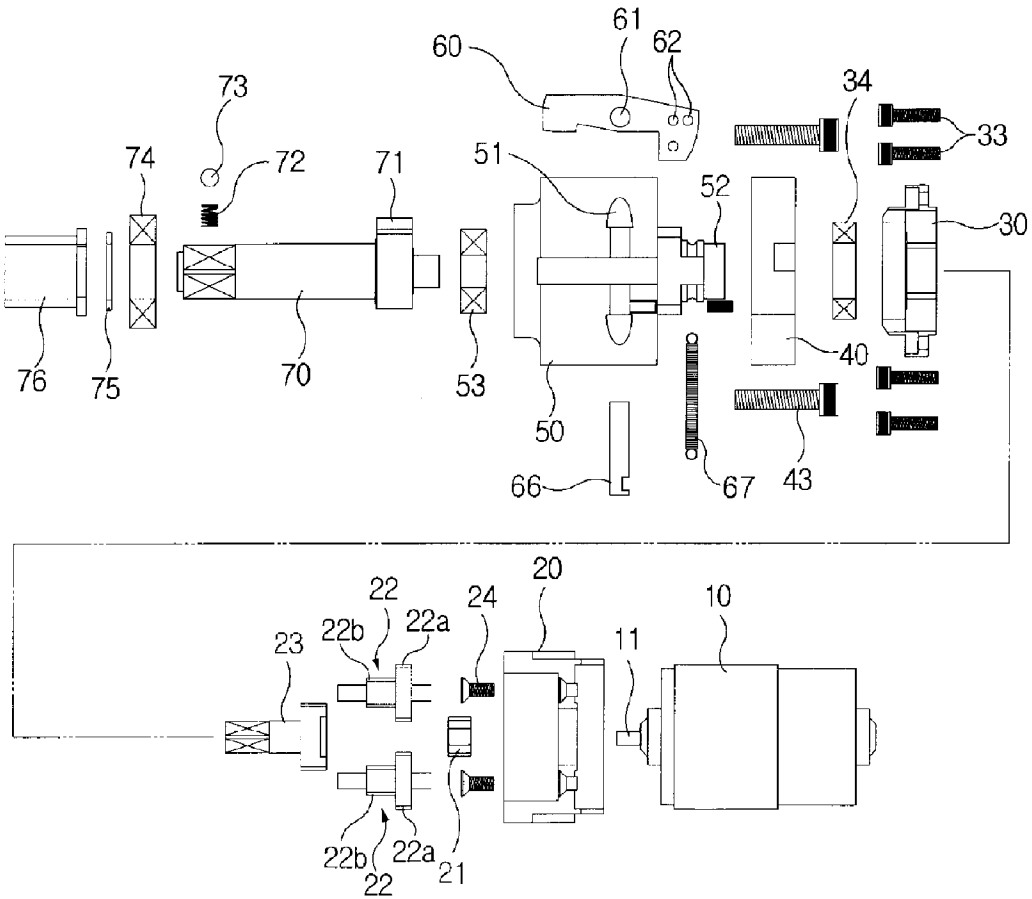
Figure 2 Prior Art
FIG. 2 is an exploded view showing a centrifugal electric impact wrench according to the present invention.

FIG. 2 is an exploded view showing a centrifugal electric impact wrench according to the present invention, FIG. 3 is a sectional view showing a centrifugal electric impact wrench of FIG. 2, and FIG. 4 is a front view showing a cover according to the present invention. FIG. 5 is a front view showing a weight member according to the present invention. FIG. 6 is a plane view showing a blow body according to the present invention. FIG. 7 is a perspective view showing an inertia wheel according to the present invention. FIG. 8 is a perspective view showing a configuration of gears in a reduction gear according to the first embodiment of the present invention. FIG. 9 is a perspective view showing a configuration of gears in a reduction gear according to the second embodiment of the present invention. FIG. 10 is an exploded perspective view showing an output gear, a cover, and a buffer cap, etc. according to another embodiment of the present invention. FIG. 11 is a perspective view showing the output gear, the cover, and the buffer cap, etc. of FIG. 10 which are assembled with one another. FIG. 12 is a longitudinal sectional view of FIG. 11, and FIG. 13 is a schematic view showing the entire configuration of a centrifugal electric impact wrench according to the present invention.

As shown in FIGS. 2 to 13, according to the present invention, an electric driving motor 10 is embedded in a housing 1 with a predetermined shape, which forms an appearance of the electric impact wrench. The electric driving motor provides driving force through a rotation shaft 11 in front thereof. Further, the housing 1 is provided with a reduction gear which is a gear box including a plurality of gears in order to improve an output torque. The reduction gear is connected to the rotation shaft 11 of the electric driving motor 10.

Here, the reduction gear includes a sun gear 21, a planetary gear 22, and an output gear 23, which are enclosed within a case 20 and a cover 30.

The case 20 is coupled to the electric driving motor 10 by bolts 24. The sun gear 21 located at a center portion in the case 20 is rotatably mounted on the rotation shaft 11 of the electric driving motor 10, and multiple planetary gears 22 are arranged around the sun gear 21. The planetary gears 22 include a first gear 22*a* engaged with the sun gear 21, and a second gear 22*b* having a smaller diameter than the first gear 22*a*, which are rotatably fixed to the case 20.

Further, the output gear 23 is engaged with the second gear 22*b* of the planetary gears 22, and is coupled to the case by inserting bolts 33 into coupling holes 31 of the cover 30 as shown in FIGS. 2 to 4. On the other hand, a leading end 23*a* of the output gear 23 protrudes through the thru-hole 32 of the cover 30 out of the cover 30.

The leading end 23*a* of the output gear 23 is connected to a connector 52 of the inertia wheel 50 to transmit the rotation force of the output gear 23 to the inertia wheel 50. A spindle 70 with a connecting body 71 is rotatably connected to the front portion of the inertia wheel 50.

Further, when centrifugal force increases over a predetermined extent by the rotation of the inertia wheel 50, a blow body 60, which hits the connection body 71, is pivotally connected to the inertia wheel 50. When a return spring 67 is connected to an end of the blow body 60 and the centrifugal force of the inertia wheel 50 is reduced below a predetermined extent, the blow body 60 is returned to an initial position by elastic restitution of the return spring 67.

According to the preferred embodiment of the present invention, the driving voltage of the electric driving motor 10 is about 12V. Therefore, a small battery may be attached as an electric source to the electric source connector 80 of the housing 1, or a DC-DC converter is installed to the electric source connector 80 of the housing so that a battery for a vehicle (generally 12V or 24V) may be used as the electric source. Further, an AC-DC converter may be embedded in the electric source connector 80 of the housing 1 so that an alternating current can be used as the electric source.

Meanwhile, the reduction gear may include two or more planetary gears 22. In FIG. 8, the first embodiment of the present invention includes two planetary gears 22.

Here, the rotation shaft 11 of the electric driving motor 10 is connected to the reduction gear. When the sun gear 21 connected to the rotation shaft 11 of the electric driving motor 10 rotates, the first gear 22*a* of the two planetary gears 22 engaged with the sun gear 21 also rotates. The output gears 23 connected to the second gears 22*b* of the planetary gear 22 rotate along with the first gears 22*a*, so as to transmit power to the inertia wheel 50.

At this time, during transmission of power to the sun gear 21, the planetary gear 22, and the output gear 23, which are designed to have a predetermined gear ratio, when the rotation velocity is lowered, output torque increases. Of course, the gear ratio may be adjusted to generate a desired reduction ratio and output torque.

Meanwhile, according to the second embodiment of the present invention, the planetary gears include three gears which are engaged with the sun gear, in order to obtain a necessary rotation velocity. The operation of the planetary gears can be sufficiently understood with reference to FIG. 9.

The inertia wheel 50 has a circular reception groove 54 formed at a side thereof, in which bearings 53 and 74 are received to rotatably support the spindle 70. Therefore, the assembly of the spindle 70 and the inertia wheel 50 is supported at both ends by the bearings 53 and 74. A ball 73 used for coupling the spindle to a socket (not shown) is mounted on a leading end of the spindle 70 and is elastically supported by a spring 72. A washer 75 and bushing 76 may be mounted on an axis of the spindle 70.

The inertia wheel 50 has a cut portion 55 which is cut lengthwise on an outer peripheral surface. As shown in FIG. 6, the blow body 60 with a desired thickness is received lengthwise between the connection members 63 in the cut portion 55. A mounting pin 64 and connection pin 65 are respectively fixed to the hole 62 of the blow body 60. The blow body 60 is mounted in the cut portion 55 to pivot upward and downward around a coupling pin 66 in such a manner that the coupling pin 66 is inserted into the coupling hole 61 and the hole 51 formed in the inertia wheel 50 in the state that the hole 51 formed in the inertia wheel 50 and the coupling hole 61 formed in the blow body 60 coincide with each other. That is, the blow body 60 is subjected to centrifugal force so that the rear portion of the blow body 60 protrudes around the coupling pin 66 when the inertia wheel 50 is rotated by the electric driving motor 10.

In order to secure a centrifugal movement of the blow body 60, a weight member 40 is additionally provided to the rear portion of the inertia wheel 50 so that the rear portion has a heavier weight than the front portion thereof. The weight member 40 has a U shaped groove 41 formed at a side thereof, and is coupled to the inertia wheel 50 by inserting the bolt 43 into the coupling hole 42. The weight member 40 may have a size adjusted according to force applied to the rear portion of the blow body 60.

On the other hand, according to another embodiment of the present invention, the weight of the rear portion of the inertia wheel 50 may increase as much as the weight corresponding to the weight member 40, instead of separately attaching the weight member 40 to the inertia wheel 50, as shown in FIG. 7. In other words, the weight member 40 may be integrated with the inertia wheel 50.

Further, the return spring 67 is installed in such a manner that its center portion sits on the connector 52 of the inertia wheel 50 and it has both ends connected to the mounting pin 65 for fixing the rear portion of the blow body 60.

In the centrifugal electric impact wrench according to the present invention, the centrifugal force applied to the rear portion of the blow body 60 is larger than elastic restitution of the return spring 67 restricting the blow body 60 when the rotation velocity of the inertia wheel 50 is about 1000 rpm.

Meanwhile, when the inertia wheel 50 rotates to hit a connection body 71 continuously, the blow body 60 must hit the connection body 71 of the spindle 70, and then release its restriction force. However, there occurs a phenomenon in which the blow body 60 and the spindle 70 are tangled with each other.

In the preferred embodiment of the present invention, a controller 81 may be connected between the electric source and the electric driving motor 10 in order to prevent this phenomenon. In this case, the controller automatically controls voltage and current in a manner of Pulse Width Modulation (PWM), so as to prevent overload from being applied to the electric source and the electric driving motor 10.

As described above, the blow body 60 instantly hits the connection body 71 and rotates the spindle 70, thereby coupling or loosening a coupling member such as bolts for mounting the wheels on the vehicle through a socket assembled with the spindle 70.

In the centrifugal electric impact wrench according to the present invention as described above, the rotation force generated by the electric driving motor 10 is reduced and converted by the reduction gear into high torque, and transmitted to the inertia wheel 50, the blow body 60, and the spindle 70. Accordingly, the centrifugal electric impact wrench can have a more stable power transmission structure.

On the other hand, according to the still another embodiment of the present invention, the centrifugal electric impact wrench may be provided with a buffer cap 78 in order to alleviate impact applied to the output gear 23 of the reduction gear, as shown in FIGS. 10 to 12.

The buffer cap 78 is made of an elastic material (for example, thermoplastic material) to have a thin cap shape, and covers the leading end 23*a* of the output gear 23.

Accordingly, since the leading end 23*a* of the output gear 23 is inserted into the connector 52 of the inertia wheel 50 with the buffer cap 78 covers on the leading end 23*a*, the buffer cap 78 can absorb or alleviate impact applied to the leading end 23*a* of the output gear 23 during the operation of the electric impact wrench, thereby greatly improving the durability of the reduction gear.

Here, it is obvious that the buffer cap 78 must be made of a material which has high impact resistance and is not expansible.

According to the present invention, although the buffer cap 78 is made of a material which has an excellent impact resistance, a reinforcement cap 79 made of metal is preferably interposed between the leading end 23*a* of the output gear 23 and the buffer cap 78. This is to minimize damage to the buffer cap 78, which occurs in the case where the buffer cap 78 directly receives strong impact from the leading end 23*a* of the output gear 23, and to endure impact through the reinforcement cap 79 primarily.

According to the present invention, in order to maximize a function in which the impact applied to the reduction gear is alleviated, a plurality of insertion grooves 36 is circumferentially formed on the inner surface 35 of the cover 30, and a buffer 77 made of elastic material is inserted into the insertion grooves 36. At this time, the buffer 77 has a structure in which a part protrudes from the inner surface 35 of the cover 30.

Therefore, whereas the bearing 34 does not come in direct contact with the inner surface 35 of the cover 30, the buffer 77 is interposed between the inner surface of the cover 30 and the bearing 34, and absorbs or alleviates impact applied to the inner surface 35 of the cover 30.

INDUSTRIAL APPLICABILITY

According to the present invention as described above, the centrifugal electric impact wrench is provided with the reduction gear which reduces rotation force generated by the electric driving motor, thereby removing a hunting element in an acceleration section and a hitting timing and stably transmitting power with high torque at a low velocity.

Further, the centrifugal electric impact wrench according to the present invention can be used for home and industry to mount and remove wheels on/from a vehicle. In addition, since the electric impact wrench can be easily carried and used while stably providing high torque at a low velocity, it can be effectively used for special equipments such as military equipment (for example, an expandable pipe coupler and the like).

Furthermore, the electric impact wrench can absorb and alleviate impact applied to the reduction gear through the buffer cap and reinforcement cap covered on the leading end of the output gear and the buffer interposed between the inner surface of the cover and the bearing, thereby greatly improving the durability of the electric impact wrench.

While this invention has been described in connection with what is presently considered to be the most practical and preferred embodiment, it is to be understood that the invention is not limited to the disclosed embodiment and the drawings, but, on the contrary, it is intended to cover various modifications and variations within the spirit and scope of the appended claims.

The invention claimed is:

1. A centrifugal electric impact wrench using an electric driving motor, which is rotated by electricity supplied from an electric power source, as a power source, the electric impact wrench comprising: a sun gear coupled to a rotation shaft of the electric driving motor; a plurality of planetary gears including first gear engaged with the sun gear, and second gear having a small diameter than the first gear; an output gear engaged with the second gear of the planetary gear; an inertia wheel rotated by rotation force transmitted from the output gear; a spindle rotatably connected to a front portion of the inertia wheel and provided with a connector at a side of the spindle; and a blow body hitting the connector when centrifugal force caused by the rotation of the inertia wheel increases over a predetermined extent, and returning to an initial position by means of a return spring when the centrifugal force caused by the rotation of the inertia wheel is reduced below a predetermined extent, wherein the inertia wheel has a cut portion which is cut lengthwise on an outer peripheral surface, the blow body is received in the cut portion and interposed between a plurality of connecting members, a mounting pin and connecting pin are respectively fixed to a hole of the blow body, and the blow body is installed in the cut portion so as to pivot upward and downward around a coupling pin in such a manner that a coupling pin extends through and is inserted into a hole and a coupling hole in a state that a coupling hole of the blow body coincides with the hole of the inertia wheel.

2. The centrifugal electric impact wrench as claimed in claim 1, further comprising: a case coupled to the electric driving motor and enclosing the sun gear, the planetary gears, and the output gear; and a cover closing an open space in the case, where a leading end of the output gear protrudes through a through hole formed in the cover.

3. The centrifugal electric impact wrench as claimed in claim 2, wherein the cover has a plurality of insertion grooves circumferentially formed on an inner surface of the cover.

4. The centrifugal electric impact wrench as claimed in claim 3, wherein a buffer made of an elastic material is inserted in the insertion grooves, and partially protrudes from the inner surface of the cover.

5. The electric impact wrench as claimed in claim 1, wherein the number of planetary gears is two.

6. The electric impact wrench as claimed in claim 1, wherein the number of planetary gears is three.

7. The electric impact wrench as claimed in claim 1, wherein the inertia wheel has circular reception grooves formed at an end of the inertia wheel, bearings are received in the reception grooves and rotatably support the spindle, and a ball used for coupling the spindle to a socket is mounted on a leading end of the spindle and elastically supported by a spring.

8. The electric impact wrench as claimed in claim 1, wherein a weight member having a U shaped groove formed is provided to a rear portion of the inertia wheel, so that the rear portion of the inertia wheel has a larger weight than a front portion of the inertia wheel.

9. The centrifugal electric impact wrench as claimed in claim 1, wherein the return spring has a center portion sitting on a connector of the inertia wheel, and both ends connected to a mounting pin to fix a rear portion of the blow body.

10. The centrifugal electric impact wrench as claimed in claim 1, wherein the electric power source is a battery embedded in an electric connector attached to a housing having a desired shape and forming an appearance of the electric impact wrench.

11. The centrifugal electric impact wrench as claimed in claim 1, wherein a DC-DC converter is installed in an electric connector attached to a housing having a desired shape and forming an appearance of the electric impact wrench, in order to use a battery for a vehicle as the electric power source.

12. The centrifugal electric impact wrench as claimed in claim 1, wherein an AC-DC converter is installed in an electric connector attached to a housing having a desired shape and forming an appearance of the electric impact wrench, in order to use a battery for a vehicle as the electric power source.

13. The centrifugal electric impact wrench as claimed in claim 1, wherein a controller is provided between the electric power source and the electric driving motor to control voltage and current in order to prevent overload from occurring.

14. The centrifugal electric impact wrench as claimed in claim 1, wherein a buffer cap made of elastic material covers on a leading end of the output gear.

15. The centrifugal electric impact wrench as claimed in claim 14, wherein a reinforcement cap is interposed between the leading end of the output gear and the buffer cap.

16. A centrifugal electric impact wrench comprising: an electric driving motor rotated by electricity supplied from an electric power source; and a reduction gear having a plurality of gears connected to the electric driving motor so as to reduce rotation velocity and improve output torque, wherein the reduction gear includes: a sun gear coupled to a rotation shaft of the electric driving motor; a plurality of planetary gears including first gear engaged with the sun gear, and second gear having a smaller diameter than the first gear; an output gear engaged with the second gear of the planetary gears; a case coupled to the electric driving motor and enclosing the sun gear, the planetary gears, and the output gear; and a cover closing an open space of the case, wherein a buffer cap made of elastic material covers on a leading end of the output gear, a reinforcement cap made of metal is interposed between the leading end of the output gear and the buffer cap, a plurality of insertion grooves is circumferentially formed on an inner peripheral surface of the cover, a buffer made of elastic material is inserted in the insertion grooves, and the buffer partially protrudes from the inner peripheral surface of the cover.

* * * * *